US010058148B1

(12) United States Patent
Wittenberg et al.

(10) Patent No.: US 10,058,148 B1
(45) **Date of Patent: *Aug. 28, 2018**

(54) ATTACHMENT MECHANISM ARCHITECTURES FOR A WATCH BAND

(71) Applicant: Apple Inc., Cupertino, CA (US)

(72) Inventors: Michael B. Wittenberg, San Francisco, CA (US); Benjamin J. Kallman, Cupertino, CA (US); Ryan C. Perkins, San Francisco, CA (US); Tatsuya Sano, San Jose, CA (US); Zhipeng Zhang, Santa Clara, CA (US); Richard H. Koch, Cupertino, CA (US); Jeffrey C. Olson, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,004

(22) Filed: Sep. 18, 2017

Related U.S. Application Data

(60) Provisional application No. 62/397,656, filed on Sep. 21, 2016.

(51) Int. Cl.
*G04B 37/00* (2006.01)
*A44C 5/20* (2006.01)
*H01R 11/30* (2006.01)

(52) U.S. Cl.
CPC ..... *A44C 5/2057* (2013.01); *H01R 11/30* (2013.01); *H01R 2201/00* (2013.01)

(58) Field of Classification Search
CPC .. A44C 5/2057; H01R 11/30; H01R 2201/00; H01R 13/6205; A41D 1/005; H01H 13/639; G04G 17/06; G04G 21/00; G04G 47/00; G04G 21/04; G04G 15/006
USPC ..... 368/282, 10, 204, 281, 37; 439/345, 660
See application file for complete search history.

(56) References Cited

U.S. PATENT DOCUMENTS

| | | | | |
|---|---|---|---|---|
| 8,976,628 | B2 * | 3/2015 | Leoni | G04G 21/00 368/10 |
| 9,274,506 | B2 * | 3/2016 | Lu | G04G 17/02 |
| 9,445,633 | B2 * | 9/2016 | Tulloch | H01R 31/06 |
| 2004/0084200 | A1 * | 5/2004 | Noirjean | A44C 5/14 174/50 |
| 2006/0140055 | A1 * | 6/2006 | Ehrsam | A44C 5/18 368/10 |
| 2007/0064542 | A1 * | 3/2007 | Fukushima | G04B 37/1486 368/282 |

* cited by examiner

*Primary Examiner* — Edwin A. Leon
(74) *Attorney, Agent, or Firm* — McDermott Will & Emery LLP

(57) ABSTRACT

A watch band can provide both a physical connection and an electrical connection with a watch body of a watch. The watch band is fixed relative to the watch body and an electrical connection is either performed either simultaneously or shortly thereafter. The electrical connection enables data and power transfer between the watch body and the watch band. The electrical connection may also be performed by a secondary user interaction. Secondary user inactions may involve the user sliding, pulling, pushing, or rotating a portion of the watch band or watch body.

20 Claims, 15 Drawing Sheets

ATTACHMENT MECHANISM ARCHITECTURES FOR A WATCH BAND

CROSS-REFERENCE TO RELATED APPLICATIONS

This application claims the benefit of U.S. Provisional Application No. 62/397,656, entitled "ATTACHMENT MECHANISM ARCHITECTURES FOR A WATCH BAND," filed Sep. 21, 2016, the entirety of which is incorporated herein by reference.

TECHNICAL FIELD

The present description relates generally to a wearable device, and, more particularly, to physical and electrical connections of a watch band to a watch body of the wearable device, such as a wristwatch or other wrist-mounted device (e.g., a smartwatch).

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device to the user can depend on the function and arrangement of the watchband.

In one example, wristwatches typically include a case and a band. The case carries the components or mechanisms of the wristwatch including the face. The band extends away from the case so that it can wrap around the wrist of a user. The band may be integral with the case. However, in most cases, the band is a separate part that is attached to the case.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
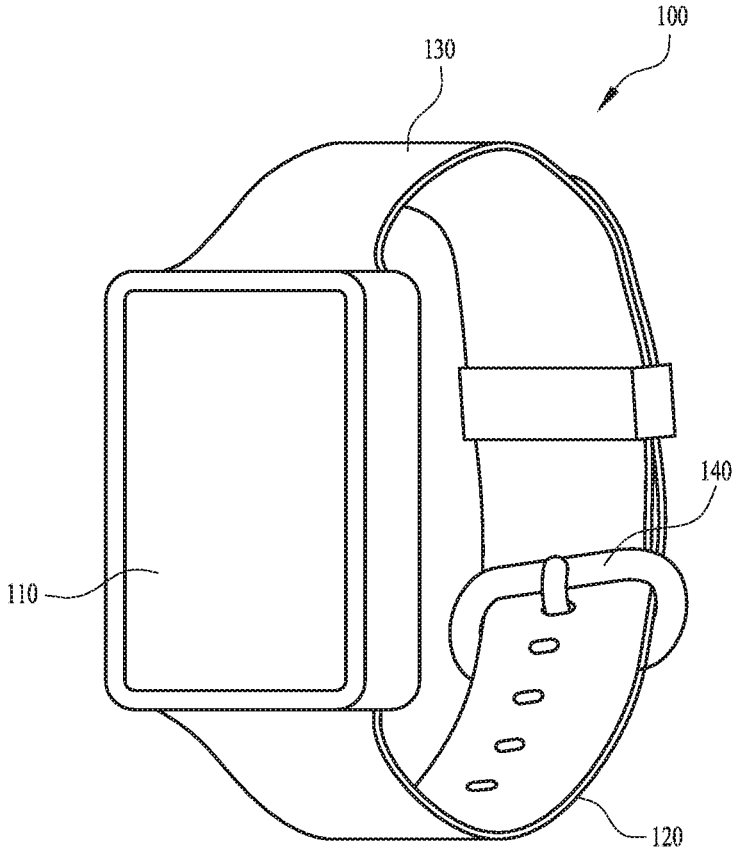
FIG. 1 shows a front perspective view of a watch with a watch band.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Smartwatches include a watch band to attach a watch body of the smartwatch to a user's wrist. To increase the functionality of the watch, independently of changing the watch body, watch bands as described herein can be used to provide additional features to the smartwatch, or to extend features of the watch body. For example, batteries, memory, processors, sensors, and additional electrical components can be integrated into the watch band to augment the user's experience. Accordingly, to provide interoperability between the watch body and features of the watch band, the watch band can do more than merely physically connect to the watch body, but can also electrically connect to the watch body in order to transfer data and power between the watch body and components of the watch band.

The following disclosure relates to mechanisms for establishing a physical connection and an electrical connection between a watch band and a watch body of a wearable device (e.g., a smartwatch). The physical connection of the watch band to the watch body can be established first to help fix the watch band relative to the watch body. The physical connection itself may not establish an electrical connection between the watch band and the watch body but can fix and lock the watch band relative to the watch body. The electrical connection can be separately established to enable data and power transfer between the watch body and the watch band. While the electrical connection can also involve physical contact between the watch body and the watch band, the purpose of the electrical connection is to establish data and power transfer between the watch body and the watch band, and in some examples not to fix or lock the watch band to the watch body.

The transfer of data and/or power between the watch band and the watch body can be performed in a number of different ways, for example, such as conductively, inductively, optically, or by any other suitable transmission mode. Establishing the physical connection between the watch body and the watch band first can help protect and align the subsequent electrical connection, especially where it includes precision electrical components, such as small-scale pin connectors (e.g., pogo pins).

The physical connection between the watch band and the watch body can be established in a number of different ways. For example, the physical connection can be established by sliding a proximal end of the watch band into a slot of the watch body. As the watch band slides into the slot of the watch body, the watch band can reach a predetermined position and a locking mechanism can lock the watch band in place. The locking mechanism physically fixes the watch band relative to the watch body and does not release the watch band from the watch body until the user disconnects the locking mechanism. After the watch band is fixed relative to the watch body, an electrical connection can be established.

The electrical connection between the watch band and the watch body can be established at a number of different times, but in some examples not before the physical connection. For example, the electrical connection can be established simultaneously with the physical connection between the watch band and the watch body. Alternatively or additionally, the electrical connection can be automatically established immediately after the physical connection is established. Alternatively or additionally, the electrical connection can be established upon a secondary user interaction after the physical connection is established. Examples of secondary user interactions can include, for example, sliding, pulling, pushing, or rotating a portion of the watch band or watch body.

Once the electrical connection is established, the watch band can include a lock-out feature that prevents disconnection of the physical connection between the watch band and the watch body until after the electrical connection is disconnected. By preventing the user from sliding the watch band in the slot before the electrical connection is disconnected, precision electrical components, such as small-scale pogo pins, can be protected.

When the user desires to swap out watch bands, the user can first disconnect the electrical connection, which disables the lock-out feature. The electrical disconnection can be automatic or user controlled. Once the lock-out feature is disabled, the user can then disconnect the physical connection to be able to slide the watch band out from the watch body.

The present disclosure details attachment mechanism architectures for a watch band that include connections between a watch body and the watch band, where the connection includes both a physical, non-electrical connection and a separate electrical connection. The physical connection fixes and locks the watch band in place relative to the watch body. The electrical connection establishes a connection between the watch body and the watch band to enable data and power transfer. While the electrical connection can also include physical contact between components of the watch body and the watch band, the purpose of the electrical connection is to enable data and power transfer. Different architectures are described herein that establish the physical connection and the electrical connection between the watch band and the watch body.

In some embodiments, the physical connection between the watch body and the watch band and the electrical connection between the watch body and the watch band can occur simultaneously. For example, as a user slides the watch band into a slot of the watch body to fix the watch band relative to the watch body, a simultaneous connection can be established between electrical components of the watch body and the watch band.

In some embodiments, the physical connection between the watch body and the watch band occurs before the electrical connection between the watch body and the watch band. For example, the user can slide the watch band into a slot of the watch body and fix the watch band relative to the watch body. After the watch band is fixed relative to the watch body and locked into place, an electrical connection between the watch body and the watch band can be established. The electrical connection can involve a secondary user interaction to establish the electrical connection. For example, establishing the electrical connection between the watch body and the watch band can involve the user performing a secondary action after the physical connection is established, such as, for example, sliding, pulling, pushing, or rotating a portion of the watch band or watch body.

In some embodiments, the physical connection between the watch body and the watch band can not be disconnected before the electrical connection between the watch band and the watch body is disconnected. The user will need to disconnect the electrical connection before the user will be able to disconnect the physical connection. Disconnecting the electrical connection first can help protect precision electrical components, such as small-scale pogo pins used to establish the electrical connection, during disconnection of the physical connection.

These and other embodiments are discussed below with reference to the figures. However, those skilled in the art will readily appreciate that the detailed description given herein with respect to these figures is for explanatory purposes only and should not be construed as limiting. Also, any feature described with respect to an individual embodiment can be applied to the other described embodiments to the extent it is not inconsistent or otherwise conflicting with the features of the other embodiments.

FIG. 1 illustrates a wearable device 100 that attaches to a user's wrist or other suitable appendage. Wearable device 100 can be, for example, a wrist-worn watch. Alternatively or additionally, the electronic device can be a portable computing device. Examples include cell phones, smart phones, tablet computers, laptop computers, timekeeping devices, computerized glasses and other wearable devices navigation devices, sports devices, accessory devices, health-monitoring devices, medical devices, wristbands, bracelets, jewelry, and/or the like.

Wearable device 100 can include a watch body 110 and a watch band 120 with a first band portion 130, a second band portion 140, and a watch band fastener 150. Watch band 120 couples to watch body 110 on opposing sides of watch body 110. First band portion 130 and second band portion 140 can physically and electrically connect to watch body. The physical and electrical connections can be separate. The physical connection fixes watch band 120 relative to watch body 110. The electrical connection enables data and/or power transfer between watch body 110 and watch band 120. Watch band 120 can secure watch body 110 to the user's wrist by fastening first band portion 130 to second band portion 140 with watch band fastener 150. Watch band fastener 150 can fasten first band portion 130 to second band portion 140 in a number of ways, for example, such as mechanical interlocks, magnets, buckles, latches, hinges, snaps, hook-and-loop fasteners, or any other suitable attachment mechanism.

Figure 2:
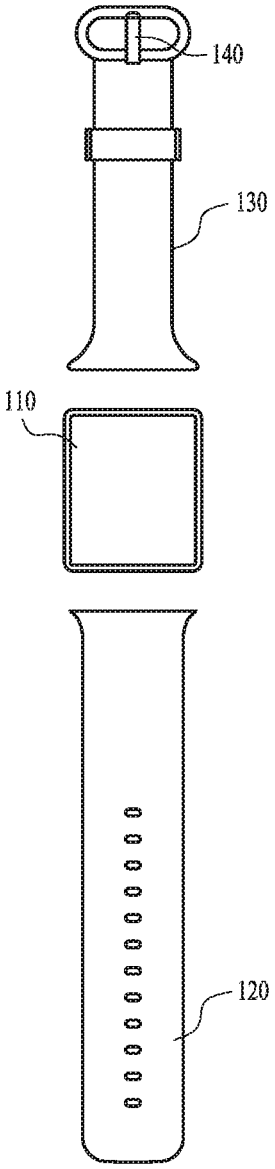
FIG. 2 shows a front view of a watch with a watch band.

FIG. 2 illustrates a view of wearable device 100 with first band portion 130 and second band portion 140 separated from watch body 110. First band portion 130 and second band portion 140 are removably attachable to watch body 110 to enable the user to swap out watch band 120 in order to suit the user's preferences. For example, watch band 120 can be swapped out based on style, color, attachment mechanism, and function of watch band 120.

Figure 4:
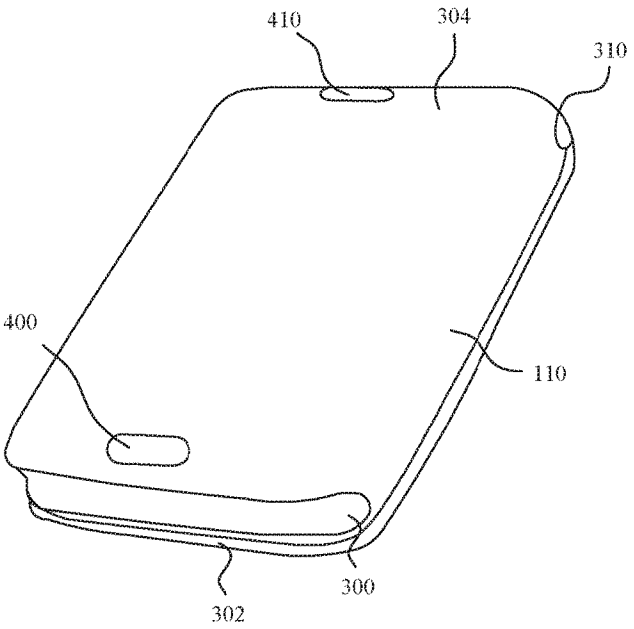
FIG. 4 shows a rear perspective view of the watch body of FIG. 3.
Figure 3:
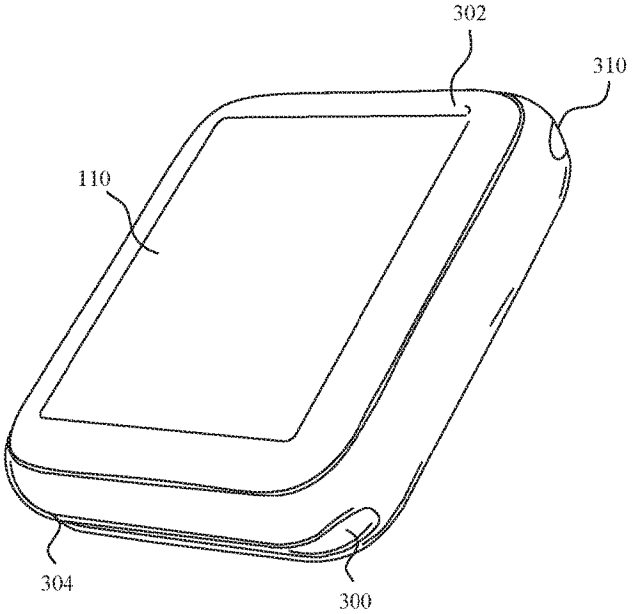
FIG. 3 shows a front perspective view of a watch body.

FIG. 3 illustrates a top perspective view of watch body 110 and FIG. 4 illustrates a bottom perspective view of watch body 110. Watch body 110 can include slots 300 and 310 for attaching first band portion 130 to watch body 110 and second band portion 140 to watch body 110. First band portion 130 can slide into slot 300 and second band portion can slide into slot 310. Slots 300 and 310 can be located at a bottom side 304 and a top side 302 of watch body 110, respectively.

As shown in FIG. 4, watch body 110 can include release buttons 400 and 410. Release buttons 400 and 410 each relate to corresponding slots 300 and 310. Release buttons 400 and 410 can release watch band 120 from slots 300 and 310 (e.g., by releasing a locking mechanism). When the user presses release button 400 or 410, watch band 120 can be released from the locking mechanism and the user is able to slide watch band 120 out of respective slots 300 and 310.

Figure 5:
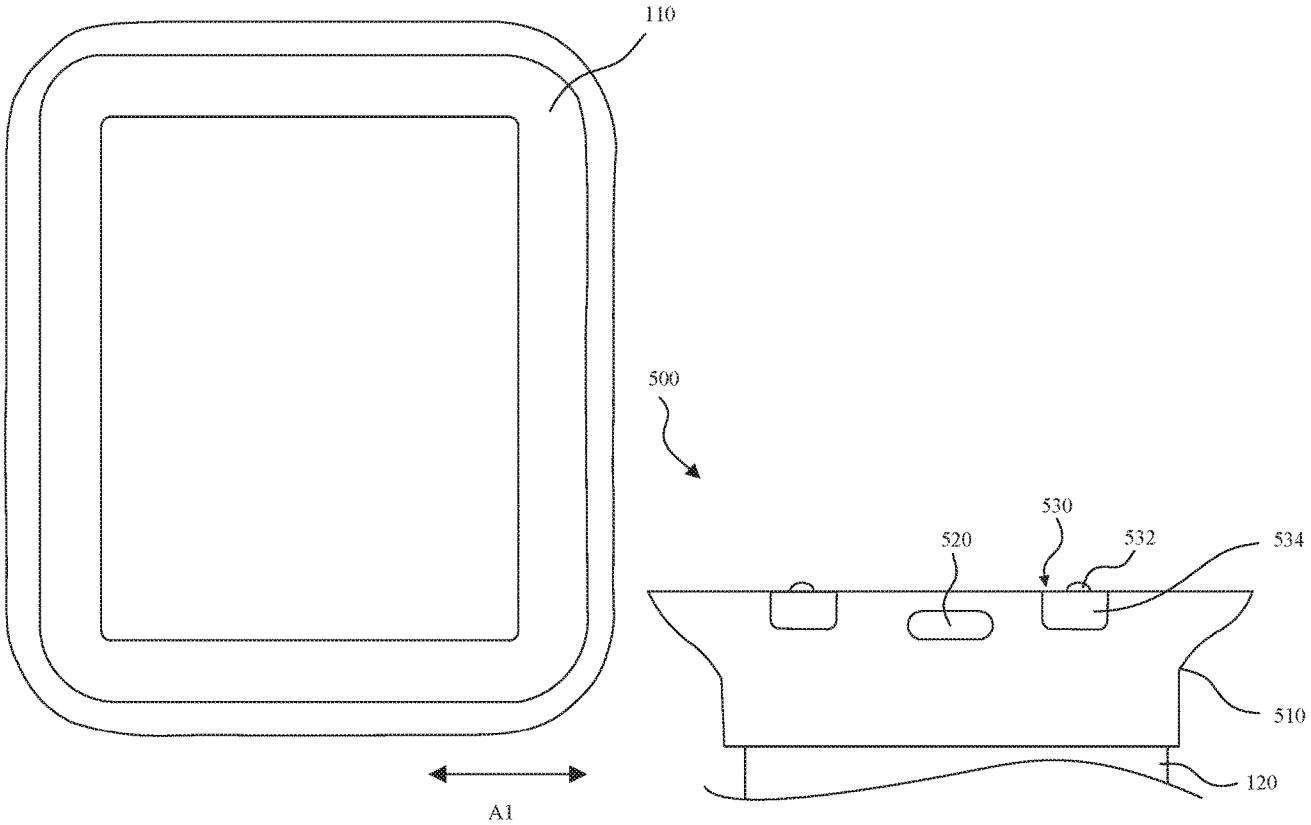
FIG. 5 shows a front view of a watch body and a watch band connector in a disengaged position.
Figure 6:
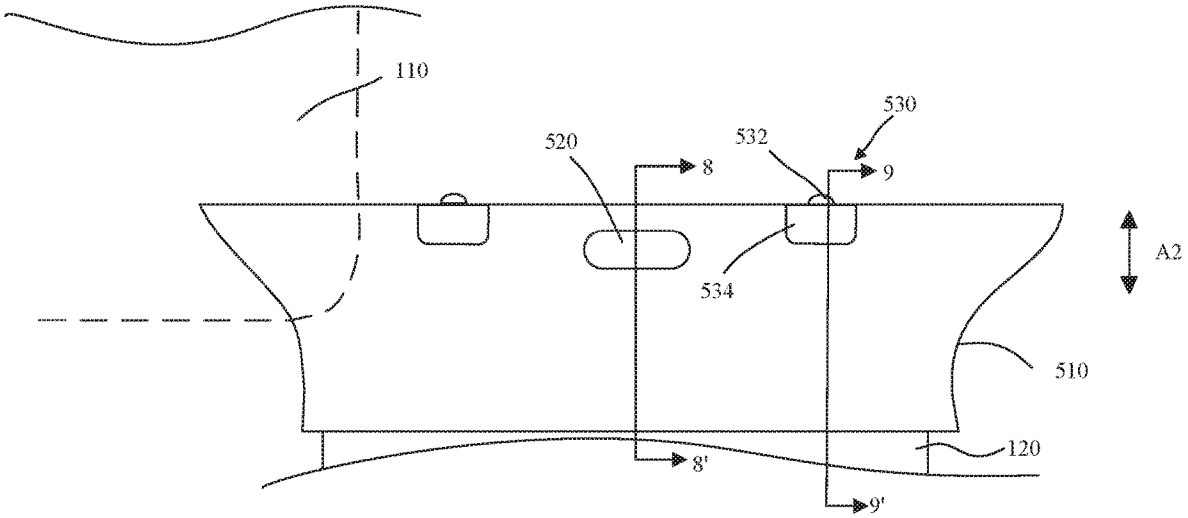
FIG. 6 shows a front view of the watch body and the watch band connector of FIG. 5 in a partially engaged position.
Figure 7:
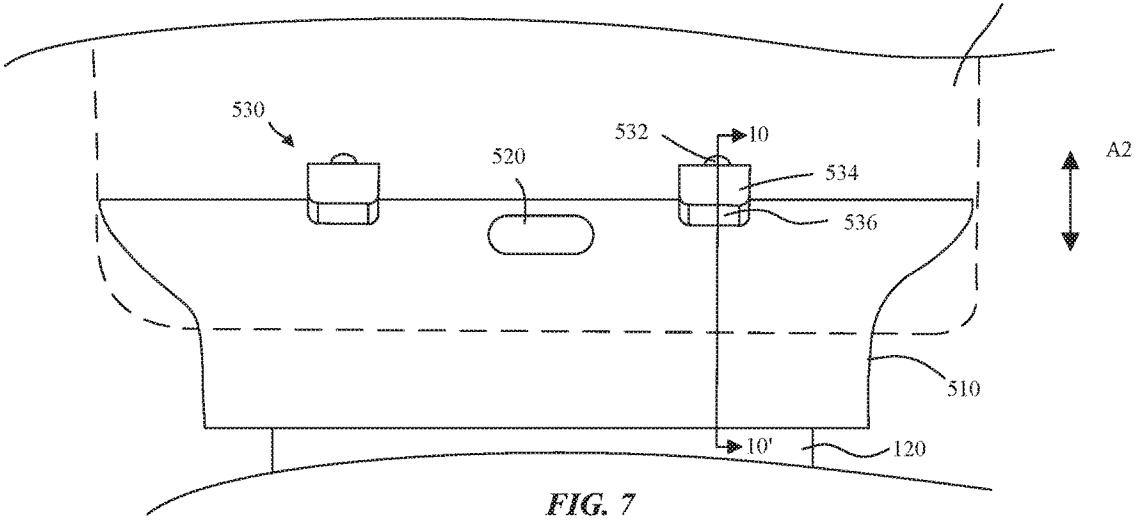
FIG. 7 shows a front view of the watch body and the watch band connector of FIG. 5 in an engaged position.

FIGS. 5-7 illustrate watch body 110 and a watch band connector 500 that can establish a physical connection and an electrical connection between watch body 110 and watch band connector 500. Watch band connector 500 functions as an attachment mechanism to attach watch band 120 to watch body 110. FIG. 5 illustrates watch band connector 500 that can slide into a slot of watch body 110 along a first direction A1, which is illustrated by the arrow. First direction A1 is coincident with the width direction of watch band 120. FIG. 6 illustrates watch band connector 500 in a partially physically engaged position, where watch band connector 500 begins to slide within the slot of watch body 110. While partially physically engaged, electrical connectors 530 remain retracted and electrically disengaged. FIG. 7 illustrates watch band connector 500 in a fully engaged position, where watch band connector 500 is fully within the slot of watch body 110. When fully engaged, electrical connectors 530 are extended and electrically engaged with watch body 110.

After a physical connection is established (i.e., after watch band connector 500 is physically fixed relative to watch body 110) electrical connectors 530 can be connected to watch body 110. As discussed, FIG. 6 illustrates pogo pins 532 of electrical connectors 530 in an electrically disengaged state (i.e., electrical connectors 530 are not electrically engaged with watch body 110), and FIG. 7 illustrates pogo pins 532 of electrical connectors 530 in an engaged state (i.e., pogo pins 532 and seal 534 have moved in a second direction A2 by extension bars 536, which is illustrated by the arrow). Second direction A2 is coincident with the length direction of watch band 120 and perpendicular to first direction A1. Accordingly, after the physical connection between watch band connector 500 and watch body 110 is established, pogo pins 532 of electrical connectors 530 can electrically contact watch body 110 to enable data and power transfer across electrical connectors 530. Seals 534 of each electrical connector 530 help ensure that pogo pins 532 are sealed from external elements, such as, for example, water, air, humidity, or other potentially detrimental environment or detritus. Seals 534 can seal pogo pins 532 by an interference fit between seals 534 and slot.

Watch band connector 500 can be interchangeably used with either of multiple slots of the watch body 110. Watch band connector 500 can include a connector body 510, a movable lock member 520, and electrical connectors 530. Lock member 520 can be non-conductive and act as an engagement member for physically connecting watch band connector 500 relative to watch body 110. Lock member 520 can be centered in a width direction of watch band connector 500. Each electrical connector 530 can include an electrical connector (e.g., pogo pin 532), a seal 534, and extension bars 536. For simplicity of explanation, electrical connectors can be referred to herein as pogo pins, however one of skill in the art will understand that such pogo pins can be replaced with alternative electrical connectors, such as contact pads or other pin connectors.

While pogo pins 532 are shown in FIG. 5 as projecting out of seal 534, the placement of pogo pins 532 is not so limited. Tips of pogo pins 532 can be in line with tops of seals 534 or in line with the proximal end of watch band connector 500. Pogo pins 532 can also be retracted within seals 534 or lower than a proximal end of watch band connector 500.

The number of electrical connectors 530 can vary depending on the format of data and power transfer between watch band 120 and watch body 110. FIG. 5 illustrates two electrical connectors 530. However, the present disclosure is not so limited and the number of connectors can be two, three, four, or more. Alternatively or additionally, pogo pins 532 and seals 534 can be housed in watch body 110 rather than in watch band connector 500.

Connector body 510 of watch band connector 500 can be integral with the rest of watch band 120. Alternatively or additionally, connector body 510 of watch band connector 500 can be a separate component coupled to a strap portion 550 that forms watch band 120.

Figure 8:
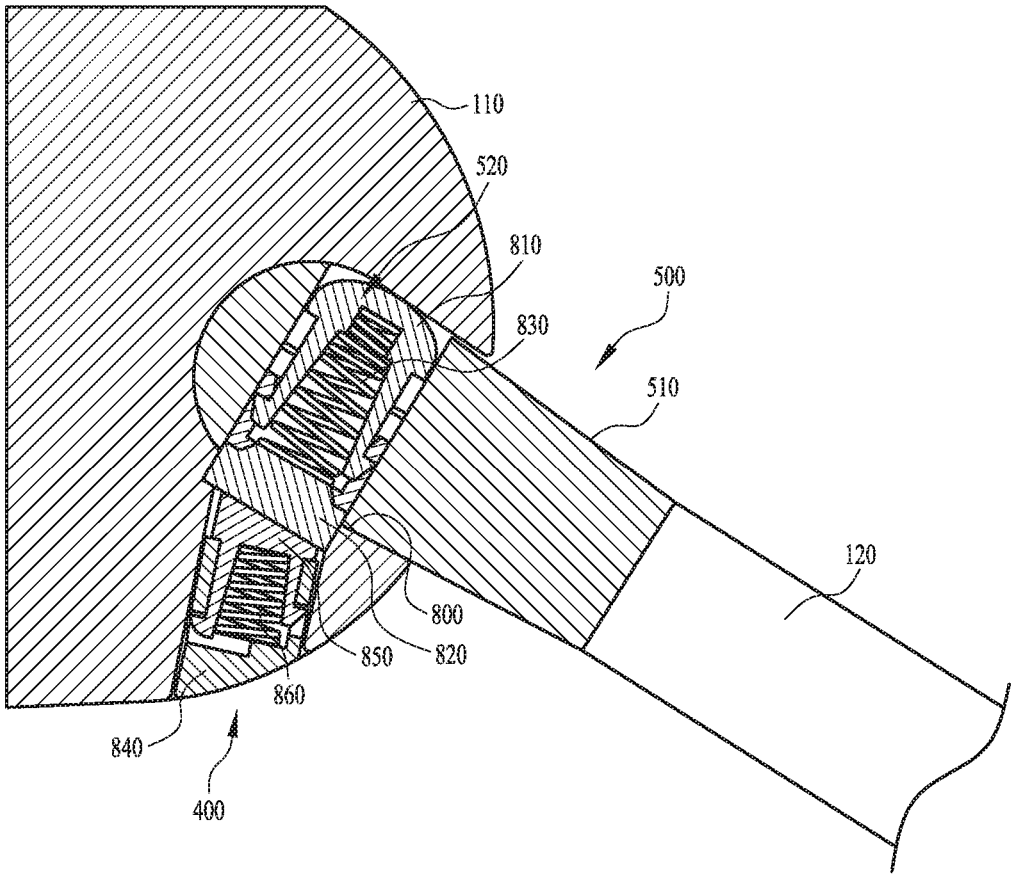
FIG. 8 shows a cross-sectional view of the watch body and the watch band connector taken along line 8-8' of FIG. 6.

Lock member 520 acts as a locking mechanism and helps establish the physical connection between watch band connector 500 and watch body 110. FIG. 8 illustrates a cross-sectional side view of watch band connector 500, lock member 520, and watch body 110 when lock member 520 is physically fixed and locked relative to watch body 110. Lock member 520 can include a ramp 810, a catch member 820, and a spring 830. Ramp 810 can project orthogonally from a surface of watch band connector 500 while catch member 820 can be flush with the opposing outer surface of watch band connector 500 when watch band connector 500 is not inserted into the slot of watch body 110. A cavity or opening 800 can be located in the slot adjacent to catch member 820. Accordingly, when lock member 520 is inserted into the slot, the slot pushes down on ramp 810 of lock member 520, which compresses spring 830. When lock member 520 reaches a predetermined catch position and catch member 820 aligns with opening 800, spring 830 expands and extends catch member 820 into opening 800, as illustrated in FIG. 8.

In order to disengage lock member 520, i.e., remove catch member 820 from opening 800, the user can actuate release buttons. The release buttons can include a button 840, a plunger 850, and a spring 860, all located within channel 870 of watch body 110. Channel 870 can be interconnected with the slot of watch body 110. The user can actuate button 840 to move button 840 along channel 870. The movement of button 840 along channel 870 can bias spring 860 and engage button 840 with plunger 850. Plunger 850 can engage with catch member 820 and move plunger 850 and catch member 820 along channel 870 which compresses spring 830. Once catch member 820 is flush with opening 800 of the slot, the user can be able to slide watch band connector 500 along the slot in first direction A1.

The physical connection between watch band connector 500 and watch body 110 can be connected in a number of different ways. The physical connection between watch band connector 500 and watch body 110 is also further described in U.S. patent application Ser. Nos. 14/696,406 and 14/789,292, which are hereby incorporated by reference in their entireties.

Figure 9:
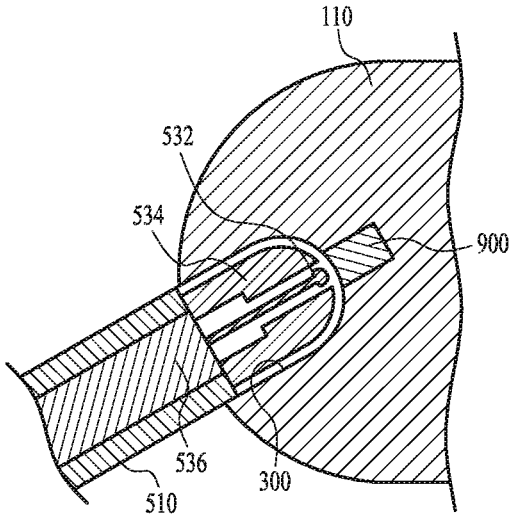
FIG. 9 shows a cross-sectional view of the watch body and the watch band connector taken along line 9-9' of FIG. 6.
Figure 10:
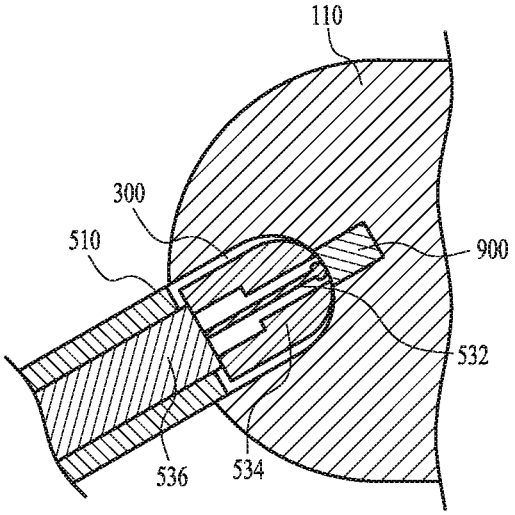
FIG. 10 shows a cross-sectional view of the watch body and the watch band connector taken along line 10-10' of FIG. 7.

FIGS. 9 and 10 illustrate a cross-sectional side view of watch body 110 and watch band connector 500. FIG. 9 illustrates pogo pin 532 in an electrically disengaged state (i.e., pogo pins 532 are not in contact with contact portion 900). FIG. 10 illustrates pogo pin 532 in an electrically engaged position (i.e., pogo pins 532 are in direct contact with contact portion 900 by movement of extension bar 536, establishing an electrical connection between pogo pins 532 and contact portion 900). As discussed previously, the electrical connection can be established automatically after the physical connection is established or the electrical connection can be established by a secondary user interaction to engage pogo pins 532 with contact portion 900.

Figure 11:
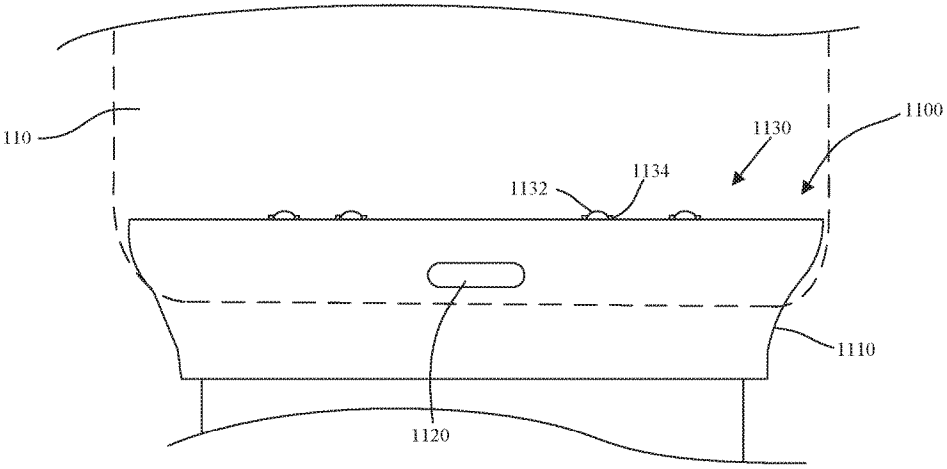
FIG. 11 shows a front view of a watch body and a watch band connector.
Figure 12:
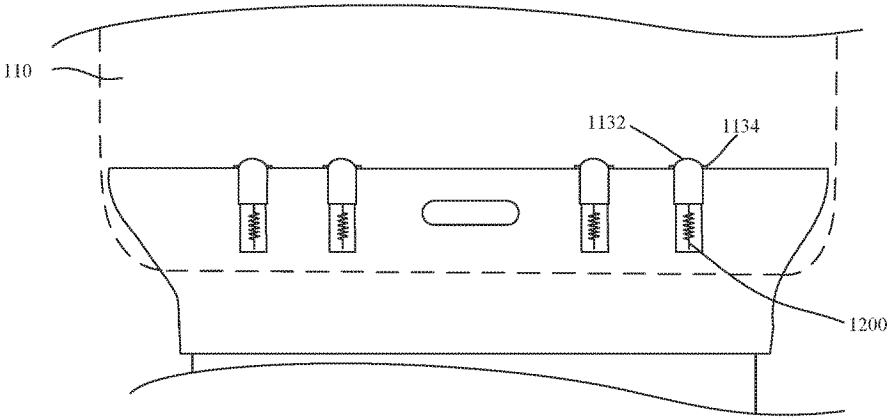
FIG. 12 shows a front schematic view of a watch body and the internal components of the watch band connector of FIG. 11.
Figure 13:
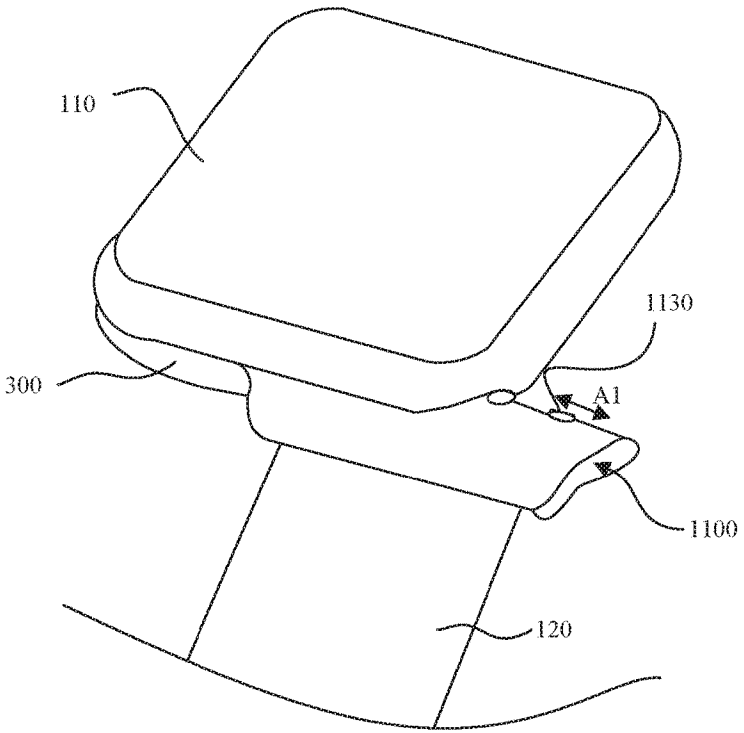
FIG. 13 shows a perspective view of the watch body and the watch band connector of FIGS. 11 and 12 sliding into a slot of the watch body.

FIGS. 11-13 illustrate an exemplary embodiment of an electrical connection between a watch band connector 1100 and watch body 110 that can be established simultaneously with the physical connection or shortly after the physical connection is established.

FIG. 11 illustrates watch band connector 1100 in solid lines whereas watch body 110 is illustrated in broken lines. Watch band connector 1100 includes a connector body 1110, a movable lock member 1120, and electrical connectors 1130. Lock member 1120 can have the same features as lock member 520 described above, including a ramp that projects orthogonally from a surface of watch band connector 1100, a catch member that is flush with the opposing outer surface of watch band connector 1100, and a spring disposed between the ramp and the catch member. Each electrical connector 1130 can have a pogo pin 1132 and a seal 1134. The number of electrical connectors 1130 can match the number of contact portions in a slot of watch body 110. For illustrative purposes, FIG. 11 illustrates watch band connector 1100 with four electrical connectors 1130, however, the number of electrical connectors 1130 can be greater than or fewer than four.

FIG. 12 illustrates a schematic view of the inner architecture of watch band connector 1100. Each pogo pin 1132 is connected to a spring 1200. Each spring 1200 has a predetermined spring constant to help establish a constant electrical connection between pogo pin 1132 and a contact portion through physical contact. While pogo pins 1132 are shown in FIGS. 11-13 as projecting out of seals 1134, the placement of pogo pins 1132 is not so limited. Tips of pogo pins 1132 can be in line with a top of seals 1134 or in line with the proximal end of watch band connector 1100. Pogo pins can also be retracted within seals 1134 or lower than a proximal end of watch band connector 1100.

FIG. 13 illustrates watch band connector 1100 sliding into slot 300 of watch body 110 along first direction A1, as illustrated by the arrow. As the user slides watch band connector 1100 into slot 300, the ramp of lock member 1120 and pogo pins 1132 come in contact with slot 300, and slot 300 pushes against the ramp of lock member 1120 and pogo pins 1132, which compresses the spring of lock member 1120 which is between the ramp and the catch member. Spring 1200 enables pogo pins 1132 to be pushed down as pogo pins 1132 come in contact with slot 300. When lock member 1120 reaches a predetermined catch position within slot 300, catch member of lock member 1120 aligns with a corresponding cavity or opening of a similar shape as the catch member within slot 300 of watch body 110. When lock member 1120 reaches the predetermined catch position, the compressed spring of lock member 1120 extends catch member of lock member 1120 into an opening in slot 300. Therefore, lock member 1120 physically locks watch band connector 1100 into place and limits the ability of watch band connector 1100 to slide along first direction A1.

When the physical connection is established between watch band connector 1100 and watch body 110, the electrical connection between pogo pins 1132 and contact portions of watch body 110 can be established. The electrical connection can occur simultaneously with the physical connection, or alternatively, after the physical connection. The electrical connection occurs when pogo pins 1132 align and are brought into contact with respective contact portions of watch body 110. Contact portions can be flush with slot 300 or slightly retracted from slot 300. Thus when pogo pins 1132 align with contact portions, springs 1200 push pogo pins against the contact portions. Alternatively or additionally, if the contact portions are retracted from slot 300, pogo pins 1132 can no longer be pushed down by slot 300, and springs 1200 can engage pogo pins 1132 in contact with the contact portions. Pogo pins 1132 and lock member 1120 can be in the same relative alignment as the contact portions and the opening in slot 300 of watch body 110 so that the physical connection and the electrical connection of watch band connector 1100 to watch body 110 can be simultaneous.

Seals 1134 of electrical connectors 1130 can be formed around pogo pins 1132 and seals 1134 hermetically seal pogo pins 1132 from external elements such as water, air, humidity, or other potentially detrimental environment or detritus. Seals 1134 can be maintained by springs 1200, which push seals 1134 against slot 300, thus creating an interference fit. Each spring 1200 can have a spring constant that provides sufficient force to create a hermetic seal for pogo pins 1132. Alternatively or additionally, the pogo pins can be a part of watch body 110 and the contact portions can a part of watch band connector 1100, reversing the locations and operation of the electrical connection components described above.

When the user desires to swap out watch bands, the user engages a release button to release the locking mechanism to enable the user to slide watch band connector 1100 from slot 300.

FIGS. 14-19 illustrate an exemplary embodiment of an electrical connection between a watch band connector 1400 and watch body 110 that can be established automatically after the physical connection is established.

Figure 14:
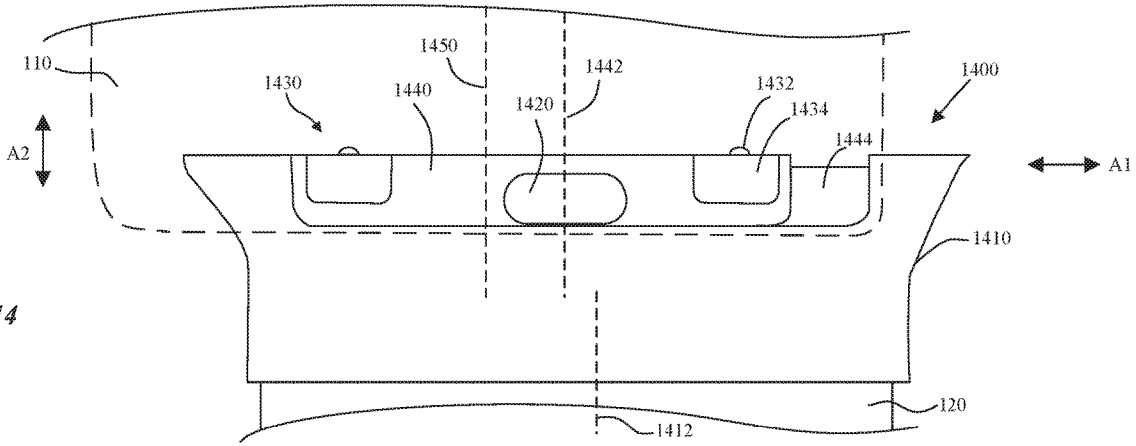
FIG. 14 shows a front view of a watch body and a watch band connector in an electrically disengaged position.

FIG. 14 illustrates watch band connector 1400 with a connector body 1410, a movable lock member 1420, and electrical connectors 1430 in an electrically disengaged state (i.e., connectors 1430 are not extended in the second direction A2). Lock member 1420 can have the same features as lock member 520 described above, including a ramp that projects orthogonally from a surface of watch band connector 1400, a catch member that is flush with the opposing outer surface of watch band connector 1400, and a spring disposed between the ramp and the catch member. Each of electrical connectors 1430 can have a pogo pin 1432 and a seal 1434. Lock member 1420 and electrical connectors 1430 can be disposed on a slide member 1440 that is configured to slide along a track 1444 in first direction A1, illustrated by the arrow. First direction A1 is coincident with the width direction of watch band 120. slide member 1440 slides in the same direction as watch band connector 1400 when watch band connector 1400 slides into a slot of watch body 110. A center 1442 of slide member 1440, which is also the center of lock member 1420, is offset from a center 1412 of connector body 1410 of watch band connector 1400 when electrical connectors 1430 are in the electrically disengaged state.

Figure 15:
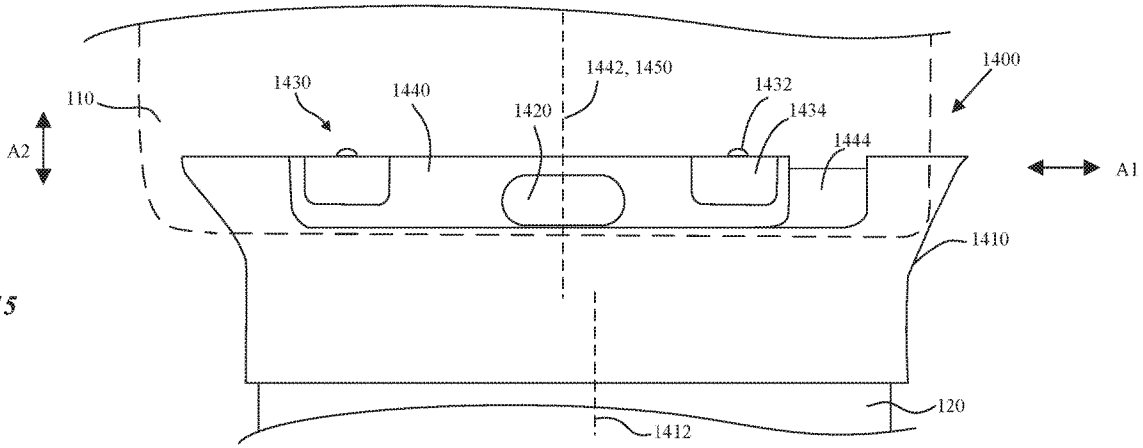
FIG. 15 shows a front view of the watch body and the watch band connector of FIG. 14 in a partially engaged position.

FIG. 15 illustrates when lock member 1420 slides to a predetermined catch position, which occurs when center 1442 of slide member 1440 aligns with center 1450 of watch body 110. When watch band connector 1400 slides in a slot, the ramp of lock member 1420 comes into contact with the slot which pushes against the ramp of lock member 1420 and compresses the spring between the ramp and the catch member. When the catch member of lock member 1420 reaches the predetermined catch position, the catch member aligns with a corresponding cavity or opening of a similar shape as the catch member of lock member 1420. When lock member 1420 reaches the predetermined catch position, the compressed spring extends the catch member of lock member 1420 extends into an opening in the slot. Once lock member 1420 locks into place, the user can continue to slide watch band connector 1400 along track 1444 in the first direction A1. As slide member 1440 continues to slide, center 1412 of connector body 1410 aligns with center 1450 of watch body 110 and center 1442 of slide member 1440, as illustrated in FIG. 16.

Figure 16:
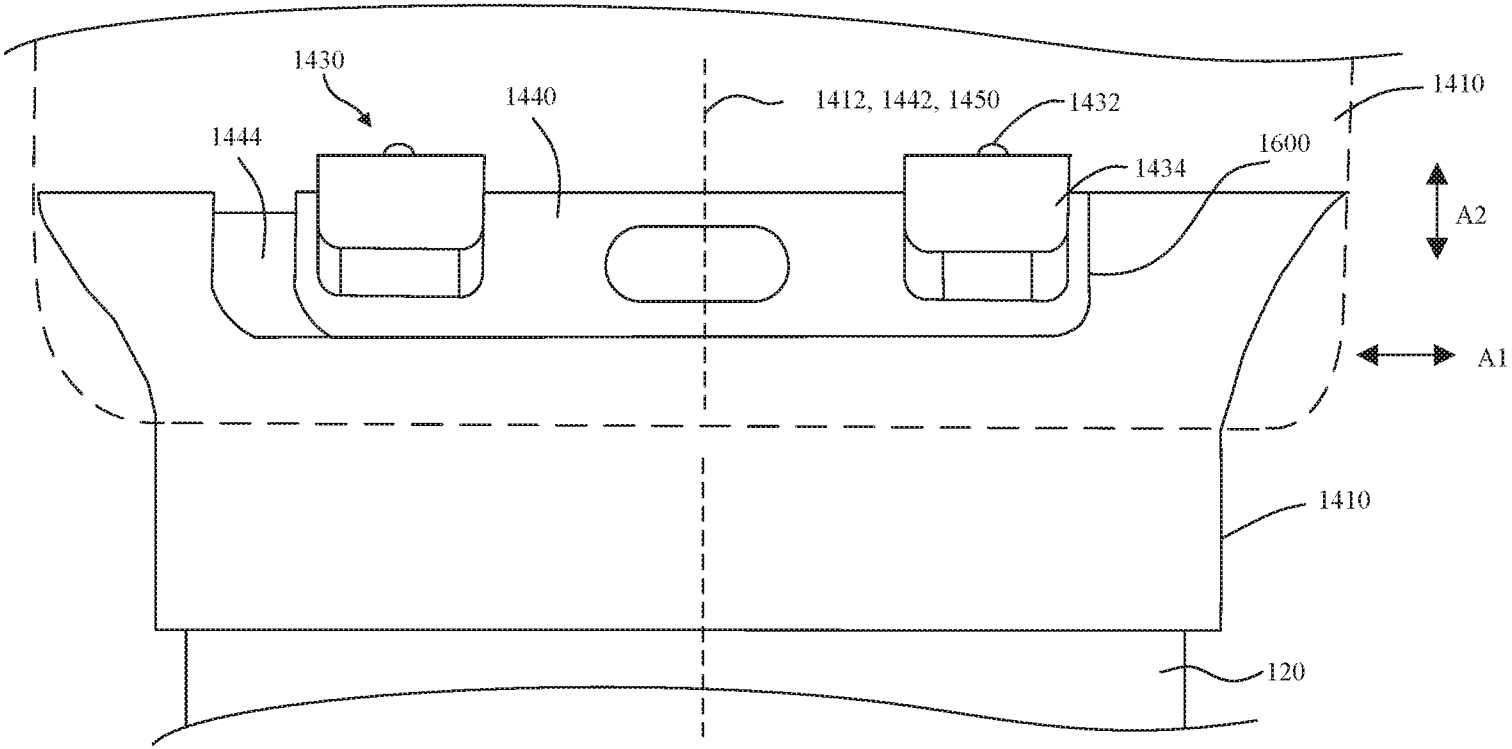
FIG. 16 shows a front view of the watch body and the watch band connector of FIG. 14 in an engaged position.

When all of the centers are aligned, as illustrated in FIG. 16, the electrical connection between watch band connector 1400 and watch body 110 can be established. When electrical connectors 1430 are in physical contact with contact portions, slide member 1440 has moved along track 1444 from a first position as illustrated in FIG. 14, to a second position, as illustrated in FIG. 16. Watch band connector 1400 can include a hard stop 1600, to help ensure that slide member 1440 stops in the second position so that pogo pins 1432 are aligned with contact portions of watch body 110.

Figure 17:
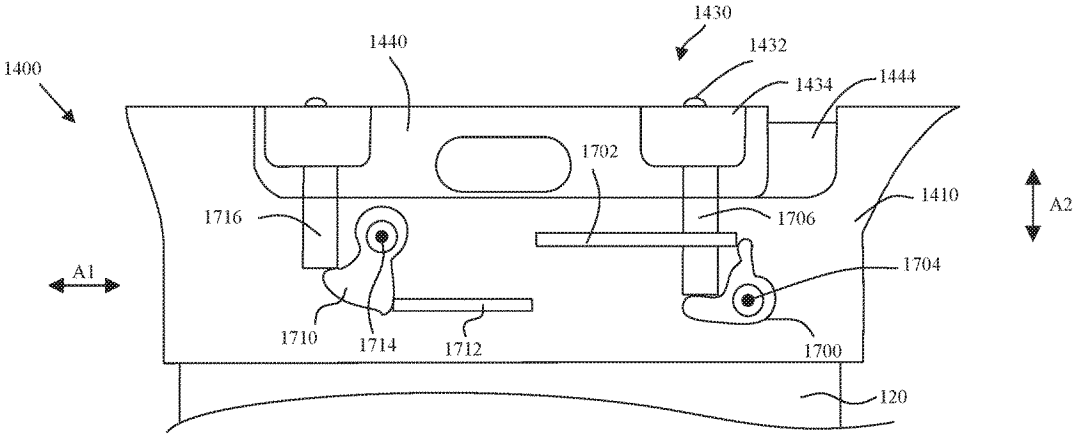
FIG. 17 shows a front schematic view of the watch band connector of FIG. 14 in an electrically disengaged position, showing internal components of the watch band connector.

FIG. 17 illustrates a schematic view of the inner architecture of watch band connector 1400. Watch band connector 1400 has a first cam 1700 that is connected to one of connectors 1430 and a second cam 1710 that is connected to another connector 1430. As slide member 1440 moves from the first position to the second position, cams 1700 and 1710 rotate and push their respective connectors 1430 from a retracted position (e.g., electrically disengaged position) into an extended position (e.g., electrically engaged position), thereby establishing an electrical connection with watch body 110. Similarly, as slide member 1440 moves from the second position to the first position, cams 1700 and 1710 rotate the other way and pull their respective connectors 1430 into a retracted position, thereby disconnecting an electrical connection with watch body 110.

For example, in some embodiments a first rigid bar 1702, which is fixed relative to slide member 1440, slides with slide member 1440 and engages first cam 1700 and causes first cam 1700 to rotate about axis 1704. The rotation of first cam 1700 causes first cam 1700 to engage second rigid bar 1706 which moves connector 1430 in second direction A2. Similarly, as slide member 1440 moves from the first position to the second position, second cam 1710 moves along with slide member 1440 and engages third rigid bar 1712 which causes second cam 1710 to rotate about axis 1714. The rotation of second cam 1710 causes second cam 1710 to engage fourth rigid bar 1716 which moves electrical connector 1430 in second direction A2. When electrical connectors 1430 have been pushed in the second direction, electrical connectors 1430 engage with respective contact portions of watch body 110 by physical contact.

Figure 18:
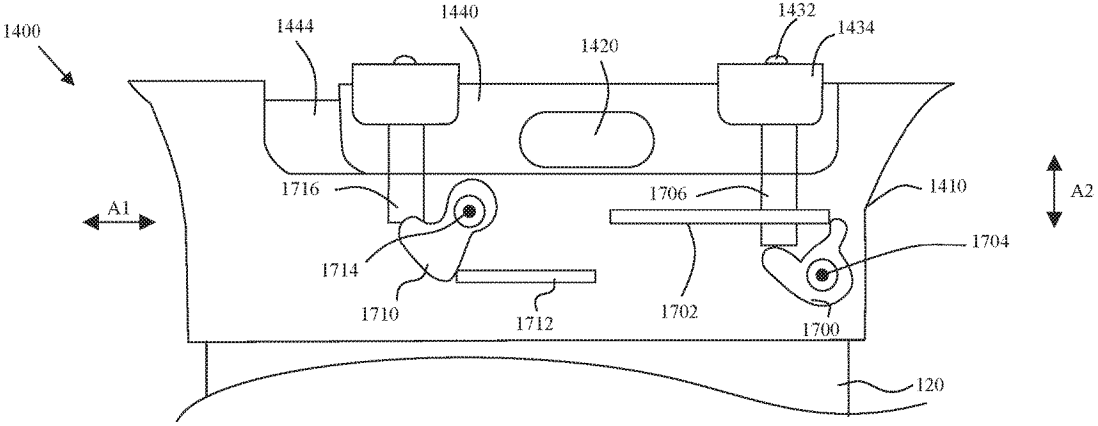
FIG. 18 shows a front schematic view of the watch band connector of FIG. 14 in an engaged position, showing internal components of the watch band connector.

FIG. 18 illustrates a schematic view of the inner architecture of watch band connector 1400 when the electrical connection is established.

Seals 1434 can be formed around pogo pins 1432 and seals 1434 hermetically seal pogo pins 1432 from external elements, such as water, air, humidity, or other potentially detrimental environment or detritus. Seals 1434 are connected to second rigid bar 1706 and fourth rigid bar 1716, which push seals 1434 against a slot, thus creating an interference fit.

The user can release watch band connector 1400 from the slot by engaging a release button on watch body 110, which releases a catch member of lock member 1420 from an opening, and enables the user to slide watch band connector 1400 from the slot. As the user begins to slide watch band connector 1400 in first direction A1, slide member 1440 slides from the second position to the first position. Since first rigid bar 1702 and third rigid bar 1712 are connected to slide member 1440, the movement of slide member 1440 also retracts connectors 1430 in the second direction A2. When slide member 1440 reaches the first position, watch band connector 1400 begins to slide out of the slot of watch body 110.

Slide member 1440 acts like a lock-out feature by retracting pogo pins 1432 while slide member 1440 slides from the second position to the first position, and before watch band connector 1400 beings to slide in the slot. Accordingly, when the user desires to swap out watch bands, the user engages the release button to release the locking mechanism to enable the user to slide watch band connector 1400 from the slot while slide member 1440 protects pogo pins 1432.

Figure 20:
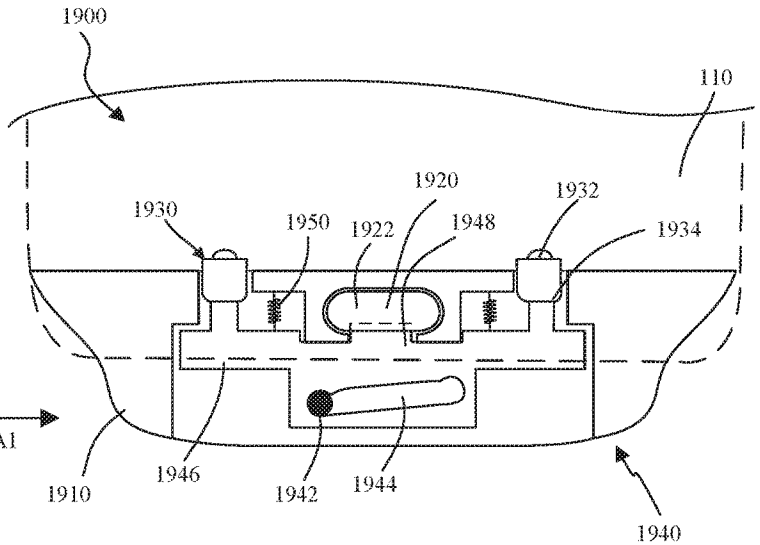
FIG. 20 shows a front schematic view of the watch body and the watch band connector of FIG. 19 in an electrically engaged position and the secondary user interaction system in a second position.
Figure 19:
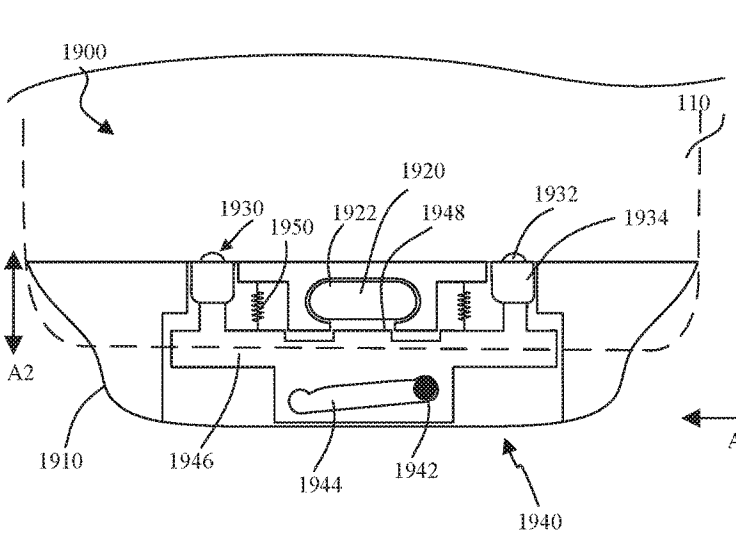
FIG. 19 shows a front schematic view of a watch body and a watch band connector in an electrically disengaged position and a secondary user interaction system in a first position.

FIGS. 19 and 20 illustrate an exemplary embodiment of an electrical connection between a watch band connector 1900 and watch body 110 which can be established by a secondary user interaction after the physical connection is established.

FIG. 19 illustrates a watch band connector 1900 with a connector body 1910, a movable lock member 1920, and electrical connectors 1930. Lock member 1920 can have the same features as lock member 520 described above, including a ramp that projects orthogonally from a surface of watch band connector 1900, a catch member that is flush with the opposing outer surface of watch band connector 1900, and a spring disposed between the ramp and the catch member. Each electrical connector 1930 can include a pogo pin 1932 and a seal 1934.

The user can slide watch band connector 1900 into a slot of watch body 110 to physically fix watch band connector 1900 relative to watch body 110. Lock member 1920 helps secure the physical connection between watch band connector 1900 and watch body 110. When watch band connector 1900 slides in the slot, the slot pushes against the ramp of lock member 1920 and compresses the spring between the ramp and the catch member. When lock member 1920 reaches a predetermined catch position within the slot, the catch member of lock member 1920 aligns with a corresponding cavity or opening of a similar shape as the catch member within the slot of watch body 110. When lock member 1920 reaches the predetermined catch position, the compressed spring extends the catch member of lock member 1920 into an opening in the slot. Lock member 1920 fixes watch band connector 1900 relative to watch body 110 and limits the ability of watch band connector 1900 to slide along first direction A1.

Watch band connector 1900 can further include a secondary user interaction system 1940 to establish the electrical connection after the physical connection is established. For example, the user can be involved in sliding, pulling, pushing, or rotating a portion of watch band connector 1900 or watch body 110. Secondary user interaction system 1940 can move pogo pins 1932 in second direction A2 to engage pogo pins 1932 with respective contact portions.

For example, FIG. 19 illustrates secondary user interaction system 1940 involving the user sliding a pin 1942 along a channel 1944. Channel 1944 can be within watch band connector 1900 and pin 1942 can be exposed to the user outside of watch band connector 1900. Channel 1944 can be a portion of a sled 1946 that is disposed within watch band connector 1900. Sled 1946 is interconnected with electrical connectors 1930 and movement of sled 1946 in second direction A2 moves electrical connectors 1930 in second direction A2. Channel 1944 can be orientated at an oblique angle relative to first direction A1, and pin 1942 can be constrained to only move in the width direction. Thus, when the user moves pin 1942 along channel 1944, sled 1946 moves in second direction A2 relative to the position of pin 1942 in channel 1944, since pin 1942 pushes against the inclined portion of channel 1944, forcing sled 1946 upward in direction A2. Exposed pin 1942 acts as a user connection control that allows the user to control the electrical connection between the watch body and the watch band.

FIG. 20 illustrates electrical connectors 1930 in an engaged position, i.e., secondary user interaction system 1940 has been employed by the user moving pin 1942 from a first position, as illustrated in FIG. 19, to a second position, as illustrated in FIG. 20. When electrical connectors 1930 are in an engaged position, pogo pins 1932 are in physical contact with respective contact portions of watch body 110, which establishes the electrical connection. Once the electrical connection has been established, data and power transfer can occur between watch band 120 and watch body 110.

Secondary user interaction system 1940 further includes a lock-out feature to prevent movement of watch band connector 1900 along first direction A1 when the electrical connection is established. In other words, when secondary user interaction system 1940 is engaged, a lock-out portion 1948 of sled 1946 engages lock member 1920 and prevents the user from releasing lock member 1920 from an opening and thus unlocking movement of watch band connector 1900 in first direction A1. For example, lock-out portion 1948 can be inserted into a space, which prevents movement of a catch member when the catch member is in the opening, e.g., the user cannot engage a release button. Since the catch member cannot be moved, the physical connection between watch band connector 1900 and watch body 110 is maintained. Accordingly, the lock-out feature prevents the user from damaging pogo pins 1932 by moving watch band connector 1900 in first direction A1 before the electrical connection is disconnected. FIG. 19 illustrates lock-out portion 1948 in a first position, in which lock-out portion does not engage with lock member 1920. However, in FIG. 20, lock-out portion 1948 is in a second position enabling lock-out portion 1948 to engage with lock member 1920 and prevent movement of watch band connector 1900, e.g. the user can not engage the release button. Movement of lock-out portion 1948 is dependent on the movement of sled 1946 in second direction A2 which occurs when the user slides pin 1942 along channel 1944.

In order to disconnect the physical connection, the user must first disconnect the electrical connection, which will automatically disengage the lock-out feature. To disconnect the electrical connection, the user slides pin 1942 in channel 1944 from the second position as illustrated in FIG. 20, to the first position as illustrated in FIG. 19. Accordingly, lock-out portion 1948 of sled 1946 no longer engages the catch member of lock member 1920, thus enabling the user to engage release buttons to disconnect the physical connection to remove watch band connector 1900 from watch body 110.

Seals 1934 can be formed around pogo pins 1932 and seals 1934 can hermetically seal pogo pins 1932 from external elements, such as water, air, humidity, or any other potentially detrimental environment or detritus. Seals 1934 are connected to sled 1946 which pushes seals 1934 against a slot thus creating an interference fit.

Secondary user interaction system 1940 can further include springs 1950. Springs 1950 can have a predetermined spring constant and can be connected to sled 1946 to help sled 1946 return to a first position while the user slides pin 1942 in channel 1944 to the first position.

Figure 21:
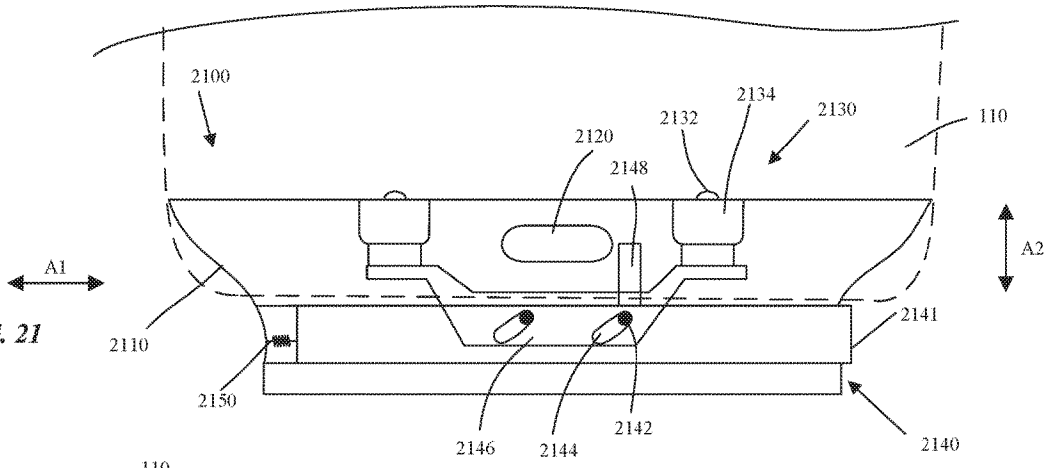
FIG. 21 shows a front schematic view of a watch body and a watch band connector in an electrically disengaged position and a secondary user interaction system in a first position.
Figure 22:
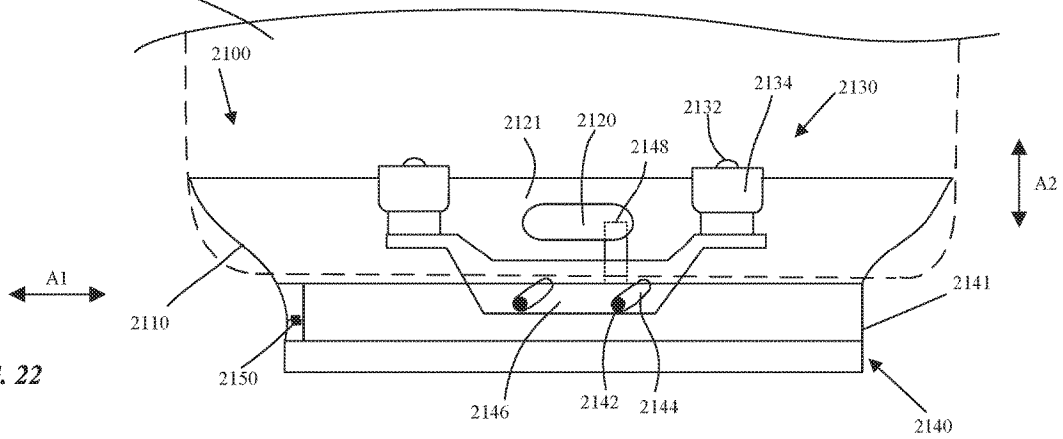
FIG. 22 shows a front schematic view of the watch body and the watch band connector of FIG. 21 in an engaged position and a secondary user interaction system in a second position.

FIGS. 21 and 22 illustrate an exemplary embodiment of an electrical connection between a watch band connector 2100 and watch body 110 which can be established by a secondary user interaction after the physical connection is established.

FIG. 21 illustrates a watch band connector 2100 with a connector body 2110, a movable lock member 2120, and electrical connectors 2130. Lock member 2120 can have the same features as lock member 520 described above, including a ramp that projects orthogonally from a surface of watch band connector 2100, a catch member that is flush with the opposing outer surface of watch band connector 2100, and a spring disposed between the ramp and the catch member. Each electrical connector 2130 can include a pogo pin 2132 and a seal 2134.

The user can slide watch band connector 2100 into a slot of watch body 110 along first direction A1 to physically fix watch band connector 2100 relative to watch body 110. Lock member 2120 helps secure the physical connection between watch band connector 2100 and watch body 110. When watch band connector 2100 slides in the slot, the slot pushes against the ramp of lock member 2120 and compresses the spring between the ramp and the catch member. When lock member 2120 reaches a predetermined catch position within the slot, the catch member of lock member 2120 aligns with a corresponding cavity or opening of a similar shape as the catch member of lock member 2120 within the slot of watch body 110. The opening can be located in the slot on an opposing side of the ramp of lock member 2120, which is adjacent to the catch member of lock member 2120. When lock member 2120 reaches the predetermined catch position, the compressed spring extends the catch member of lock member 2120 into an opening in the slot. Lock member 2120 fixes watch band connector 2100 relative to watch body 110 and limits the ability of watch band connector 2100 to slide along first direction A1.

Watch band connector 2100 can further include a secondary user interaction system 2140 to establish the electrical connection after the physical connection is established. Secondary user interaction system 2140 can move pogo pins 2132 in second direction A2 to physically contact pogo pins 2132 with respective contact portions.

For example, FIG. 21 illustrates secondary user interaction system 2140 wherein the user can push a button 2141 along a channel 2143. Button 2141 can be biased by a spring 2150, which is located at end 2152 opposite end 2154 that the user pushes to engage secondary user interaction system 2140. When the user pushes button 2141, pins 2142 attached to button 2141 are moved in the width direction within channels 2144. Channels 2144 can be defined by a sled 2146 that moves electrical connectors 2130 in second direction A2. Sled 2146 can be disposed with watch band connector 2100. Channels 2144 can be oriented at an oblique angle relative to first direction A1, whereby, when the user pushes button 2141 in first direction A1 (i.e., the direction of movement of the button when pressed), pins 2142 move along channels 2144 and push against inclined portions of channels 2144, forcing sled 2146 upward in direction A2. FIG. 21 illustrates two pins 2142; however, sled 2146 can include more or fewer than two pins 2142 and two channels 2144. Exposed button 2141 acts as a user connection control that allows the user to control the electrical connection between the watch body and the watch band.

FIG. 22 illustrates electrical connectors 2130 in an engaged position. The secondary user interaction system has been employed by the user, moving pins 2142 from a first position, as illustrated in FIG. 21, to a second position, as illustrated in FIG. 22. When electrical connectors 2130 are in an engaged position, pogo pins 2132 can be in physical contact with respective contact portions, which establishes the electrical connection. Once the electrical connection has been established, data and power transfer occur between watch band 120 and watch body 110.

Secondary user interaction system 2140 further includes a lock-out feature to prevent movement of watch band connector 2100 along first direction A1 when the electrical connection is established. In other words, when secondary user interaction system 2140 is engaged, a lock-out portion 2148 of the button 2141 prevents the user from releasing lock member 2120 from the opening and thus unlocking movement in first direction A1. For example, lock-out portion 2148 can be inserted into a space, which prevents movement of a catch member when the catch member is in an opening. Since the catch member cannot be moved, the physical connection between watch band connector 2100 and watch body 110 is maintained. Accordingly, the lock-out feature prevents the user from damaging pogo pins 2132 by moving watch band connector 2100 in first direction A1 before the electrical connection is disconnected. FIG. 21 illustrates lock-out portion 2148 in a first position, in which lock-out portion does not engage with lock member 2120. However, in FIG. 22, lock-out portion 2148 is in a second position enabling lock-out portion 2148 to engage with lock member 2120 and prevents movement of lock member 2120, e.g. the user can not engage release buttons. Movement of lock-out portion 2148 is dependent of the movement of button 2141 and sled 2146 which can be moved by the user engaging button 2141 which activates spring 2150 to push spring along channel 2144.

In order to disconnect the physical connection, the user must first disconnect the electrical connection, which will automatically disconnect the lock-out feature. To disconnect the electrical connection, the user pushes button 2141 to activate spring 2150 to move pin 2142 in channel 2144 from the second position as illustrated in FIG. 22, to the first position as illustrated in FIG. 21. Accordingly, lock-out portion 2148 of sled 2146 no longer engages lock member 2120, thus enabling the user to engage release buttons to disconnect the physical connection. The user can then engage release buttons to remove watch band connector 2100 from watch body 110.

Seals 2134 can be formed around pogo pins 2132 and seals 2134 hermetically seal pogo pins 2132 from external elements, such as water, air, humidity, or other potentially detrimental environment or detritus. Seals 2134 are connected to sled 2146, which pushes seals 2134 against the slot, thus creating an interference fit.

Figure 23:
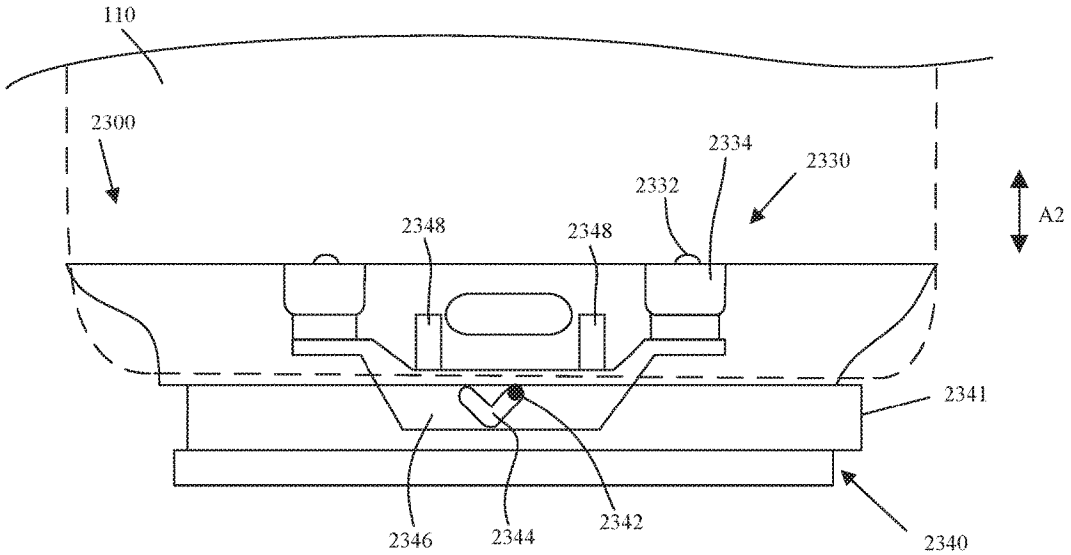
FIG. 23 shows a front schematic view of a watch body and a watch band connector with pogo pins in an electrically disengaged position and a secondary user interaction system in a first position.

FIG. 23 illustrates an alternative embodiment similar to watch band connector 2100 except watch band connector 2300 has a sled 2346 with a V-shape channel 2344. Secondary user interaction system 2340 is in an electrically disengaged state (i.e., pin 2342 is at a top of the V). In this configuration the user can push button 2341 along first direction A1 to move the electrical connectors 2330 into an electrically engaged position. When the user pushes button 2341, the button moves pin 2342 moves from a top of the V-shape channel 2344 to the cusp of V-shaped channel 2344. The movement of pin 2342 moves sled 2346 in second direction A2 through contact with inclined portions of channel 2344. Similarly as described above for channels 1944 and 2144, this contact forces sled 2346 upward and puts pogo pins 2332 in physical contact with respective contact portions, which establishes the electrical connection. Once the electrical connection has been established, data and power transfer can occur between watch band 120 and watch body 110.

To disconnect the electrical connection, the user pushes the button 2341 in either direction, which will move pin 2342 along the V-shape channel 2344, which will move sled 2346 in second direction A2, and the physical contact between pogo pins 2332 and contact portions will be disconnected. Sled 2346 can include two lock-out portions 2348, which are similar to lock-out portion 2348 discussed above. Lock-out portions 2348 can enable the user to push the button 2341 in either direction to engage the lock-out feature.

Accordingly, the embodiments discussed herein provide locking mechanisms that facilitate engagement with longitudinal movement and disengagement with lateral and/or longitudinal movements. The engagement is therefore intuitive and comfortable for execution by a user. The engagement provides secure attachment that is controllably released with ease by a user.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A watch comprising:

a watch body comprising a slot; and a watch band physically and electrically connectable to the watch body by sliding laterally into the slot, wherein the watch band comprises:

a connector body; and a slide member configured to slide laterally on a track of the watch band and relative to the connector body, such that:

when the watch band slides within the slot, the slide member does not move on the track until the watch band reaches a physically engaged position, and as at least a portion of the watch band slides past the physically engaged position, the slide member slides on the track to deploy an electrical connector disposed on the slide member toward the watch body to electrically connect to the watch body.

2. The watch band of claim 1, wherein the watch band further comprises a catch member configured to engage the watch body when the watch band reaches the physically engaged position, wherein the electrical connector is configured to move toward the watch body when the connector body slides past the physically engaged position.

3. The watch band of claim 1, wherein at the physically engaged position, a catch member of the watch band extends into an opening in the slot of the watch body and prevents further movement of the slide member within the slot.

4. The watch band of claim 3, wherein the electrical connectors electrically connect to the watch body at an electrically engaged position by extending from the connector body.

5. A watch band for connecting to a watch body, the watch band comprising:

a watch band connector body comprising:

a catch member configured to engage the watch body when the watch band connector body is partially inserted in a first direction into a slot of the watch body; and an electrical connector configured to move in a second direction, different than the first direction, toward the watch body when the watch band connector body is moved in the first direction from partially inserted to fully inserted into the slot.

6. The watch band of claim 5, wherein the watch band connector body is configured to slide into the slot of the watch body in a first direction, the first direction being in a width direction of the watch band, the catch member is disposed in a center of the watch band connector body in the width direction, and the catch member engages an opening in the slot of the watch body to fix at least a portion of the watch band to the watch body.

7. The watch band of claim 6, wherein the electrical connector is engaged with a contact portion within the slot while the catch member engages the opening in the slot.

8. The watch band of claim 5, wherein the electrical connector includes a pogo pin that is configured to physically contact an electrical contact of the watch body.

9. The watch band of claim 8, wherein the electrical connector includes a seal that surrounds the pogo pin, and when the pogo pin physically contacts the electrical contact, the seal hermetically seals the pogo pin between the watch band connector body and the watch body through an interference fit.

10. A wearable device comprising:

the watch band of claim 5; and the watch body, wherein the watch body defines the slot extending a width of the watch body, and wherein the watch band is connectable to the watch body via the slot.

11. A watch band comprising:

a watch band connector body configured to removably and physically connect the watch band to a watch body by moving in a lateral direction;

an electrical connector configured to electrically connect to the watch body; and a sled configured to move laterally within the watch band connector body to cause the electrical connector to move perpendicular to the lateral direction and to extend away from or retract toward the watch band connector body.

12. The watch band of claim 11, wherein movement of the sled is caused by actuating an exposed connection control.

13. The watch band of claim 11, further comprising a catch member configured to project from an outer surface of the watch band connector body, the catch member disposed in a center of the watch band connector body in a width direction, wherein the catch member is configured to engage with an opening in a slot of the watch body to fix the watch band to the watch body, and the electrical connector is configured to electrically connect to the watch body after the catch member engages with the opening.

14. The watch band of claim 13, wherein the catch member cannot be released from the opening in the slot until the electrical connection has been disconnected from the watch body.

15. The watch band of claim 13, wherein the electrical connector engages with the watch body after the watch band connector body is physically fixed relative to the watch body and after a secondary user interaction system is engaged.

16. The watch band of claim 15, wherein the secondary user interaction system comprises:

the sled disposed within the watch band connector body, the sled being connected to the electrical connector;

a channel defined by the sled, the channel having an oblique angle relative to the width direction of the watch band; and a pin within the channel configured to project from within the watch band connector body to outside the watch band connector body.

17. The watch band of claim 16, wherein the electrical connector is engaged by moving the pin along the channel from a first position to a second position, and movement of the pin from the first position to the second position moves the sled within the watch band connector body and simultaneously moves the electrical connector in a direction perpendicular to the width direction of the watch band.

18. The watch band of claim 15, wherein the secondary user interaction system comprises:

the sled disposed within the watch band connector body, the sled being connected to the electrical connector, a slot defined by the sled, the slot having an oblique angle relative to the width direction of the watch band; and a pin within the slot, the pin is connected to a button that is configured to laterally project from the watch band connector body.

19. The watch band of claim 18, wherein the electrical connector is engaged by pushing the button inward from a first position to a second position, and movement of the button pushes the pin along the slot from a first slot position to a second slot position, the movement of the pin from the first slot position to the second slot position moves the sled within the watch band connector body and simultaneously moves the electrical connector in a direction perpendicular to the width direction of the watch band.

20. A wearable device comprising:

the watch band of claim 11; and the watch body, wherein the watch body defines a slot extending a width of the watch body, and wherein the watch band is connectable to the watch body via the slot.

* * * * *